US005425007A

United States Patent [19]

Walter et al.

[11] Patent Number: 5,425,007

[45] Date of Patent: Jun. 13, 1995

[54] SECURING BAND MECHANISM

[76] Inventors: Richard J. Walter, 4866 Floresta Ct., Westlake Village, Calif. 91362; Scott M. Lipsett, 934 Barber La., Ventura, Calif. 93003

[21] Appl. No.: 201,675

[22] Filed: Feb. 25, 1994

[51] Int. Cl.[6] ..... G04B 37/00

[52] U.S. Cl. ..... 368/282; 224/176

[58] Field of Search ..... 368/281, 282; 224/175, 224/176, 178, 180

[56] References Cited

U.S. PATENT DOCUMENTS

| | | | |
|---|---|---|---|
| 4,639,144 | 1/1987 | Chau | 368/276 |
| 4,855,973 | 8/1989 | Crocco | 368/282 |
| 4,855,974 | 8/1989 | Steinmann | 368/282 |
| 5,222,765 | 6/1993 | Pileggi | 281/51 |

FOREIGN PATENT DOCUMENTS

| | | | |
|---|---|---|---|
| 580932 | 10/1976 | Switzerland | 224/176 |
| 432577 | 7/1935 | United Kingdom | 224/176 |

OTHER PUBLICATIONS

Watch and watch strap with hook and loop attaching mechanism (three photographs).

*Primary Examiner*—Bernard Roskoski

*Attorney, Agent, or Firm*—Denton L. Anderson; Sheldon & Mak, Inc.

[57] ABSTRACT

A securing band mechanism for snugly and securely wrapping around an object such as a person's wrist comprises: (a) a band; (b) a slotted receiver; and (c) two attaching mechanisms. The band is long enough so that one end of the band can be slid through the slotted receiver and doubled back along the band. The end section can then be sandwiched and attached on both sides between two other portions of the band by connecting matching hook and loop material on the band. Another end of the band can be slid through two slots in the slotted receiver to adjust the size of a closed loop formed by the band. The band can have a catching tab or, alternatively, two ears for preventing the slotted receiver from sliding off the band.

22 Claims, 2 Drawing Sheets

SECURING BAND MECHANISM

BACKGROUND

The present invention relates to bands which can be secured to an object.

Such bands have been created for various purposes. For example, a variety of watch bands for securing a watch to a person's wrist have been designed. However, most such band mechanisms are not suitable for strenuous activities in corrosive environments such as surfboarding or water skiing. When a person is engaged in strenuous activities, the means for securing the watch band to the wrist must be extremely secure. Otherwise, the strong forces acting on the band, such as the turbulent wave action found in heavy surf or a forceful contact with a tow line, may dislodge the watch and watch band.

For the foregoing reasons, there is a need for a securing band mechanism for attachment to an object which:

(1) provides a highly secure means for attaching the band to the object;
(2) is inexpensive to make;
(3) is easy to use;
(4) is durable;
(5) is comfortable when it used on a person's body;
(6) is light in weight;
(7) can be adjusted to fit varying sizes of objects;
(8) has means for preventing the ends of the band from detaching from one another;
(9) is corrosion-resistant;
(10) has no hard protrusions that will scratch the wearer or tear a wet suit; and
(11) is easily and securely attachable to an item, such as a watch or compass.

SUMMARY

The present invention is directed to a securing band mechanism that satisfies the foregoing needs.

A securing band mechanism according to the present invention is for snugly and securely wrapping around an object and comprises a band having: (i) a first end section; (ii) a second end section; (iii) a first middle section between the first end section and the second end section; and (iv) a second middle section hingedly attached to the first middle section. The securing band mechanism further comprises a slotted receiver connected to the second end section and for receiving an end of the band adjacent the first end section so that the band forms a closed loop around the object. The securing band mechanism also has attaching mechanisms connected to the band for attaching the first end section to the first middle section and the second middle section. When the attaching mechanisms are engaged, the first end section extends through the slotted receiver and is doubled back adjacent to and substantially parallel with the first middle section.

The securing band mechanism can further comprise an adjustment mechanism for adjustably receiving the second end section so that the closed loop can be adjusted in size. The adjustment mechanism can comprise two slots in the slotted receiver so that the second end section of the band can be weaved through the slots to adjust the size of the closed loop.

The attaching mechanisms can be comprised of hook and loop material where the loop material is attached to both sides of the first end section of the band and the hook material is attached to both the first and second middle sections. The loop material can extend substantially the entire length of the inner surface of the first end section or, alternatively, less than the entire length of the first end section.

The securing band mechanism can also have ears attached near the first end of the band to prevent the first end from sliding out of the slotted receiver to open the closed loop. Alternatively, the securing band mechanism can have a catching tab hingedly attached to the first end section to prevent the first end from sliding out of the slotted receiver.

A watch combination for attachment to a person's wrist can comprise a watch and the securing band mechanism wherein the band is attached to the watch.

A securing band mechanism according to the present invention provides a highly secure means for attaching the mechanism to the object. A plurality of attaching mechanisms are provided which prevent the closed loop from opening or being enlarged when the attaching mechanisms are activated. One end of the band is inserted through the slotted receiver and doubled back past the receiver before the attaching mechanisms are activated to further secure attachment to the object. The securing band mechanism is also easy to use and inexpensive to make.

DRAWINGS

These and other features, aspects, and advantages of the present invention will become understood with regard to the following description, appended claims and accompanying drawings where:

DESCRIPTION

Figure 3:
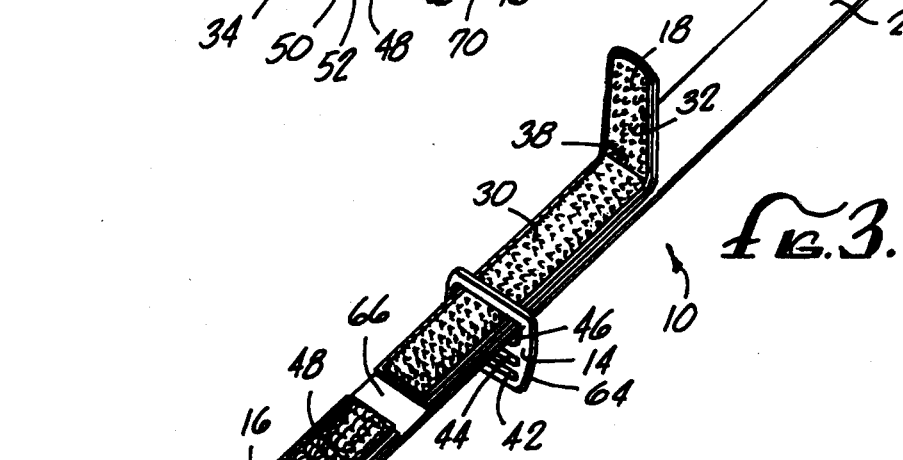
FIG. 3 is a perspective view of the securing band mechanism of FIG. 1 not forming a closed loop and not having a watch attached to the mechanism.

Turning to the drawings, a securing band mechanism 10 having a band 12, a slotted receiver 14, a first attaching mechanism 16, and a second attaching mechanism 18 is disclosed. All of the drawings except FIG. 3 show a watch 20 attached to the securing band mechanism 10. The band 12 passes between a first pin 22 and the watch 20, beneath the watch 20 and then between a second pin 24 and the watch 20.

The band 12 comprises a first end section 26, a second end section 28, a first middle section 30, and a second middle section 32. The first end section 26 has a first end 34 and the second end section 28 has a second end 36. The first middle section 30 is between and attached to the first end section 26 and the second end section 28. The second middle section 32 has an attaching end 38 hingedly attached to the first middle section 30. The second middle 32 is hingedly attached to the first middle section 30 so that the second attaching mechanism 18 can be engaged.

The slotted receiver 14 is connected to the band 12 for slidably receiving the first end 34 and the second end 36 of the band 12 so that the band 12 can form a closed loop 40. The slotted receiver has a first slot 42, a second slot 44 and a third slot 46. The first and second slots 42 and 44 receive the second end section 28 and the third slot 46 receives the first end section 26 in order to form the closed loop 40. The slotted receiver 14 is preferably slightly curved at a radius of about ¾ inch and at an angle of about thirty degrees (30°), if the mechanism 10 is to be used as a watch band.

The first end section 26 has a first end inner surface 48 and a first end outer surface 50. First loop material 52 is attached to the first end inner surface 48 and second loop material 54 is attached to the first end outer surface 50.

The first middle section 30 has a first attaching surface 56 and the second middle section 32 has a second attaching surface 58. First hook material 60 is attached to the first attaching surface 56 and second hook material 62 is attached to the second attaching surface 58.

The first attaching mechanism 16 comprises the first loop material 52 and the first hook material 60. The second attaching mechanism comprises the second loop material 54 and the second hook material 62.

Figure 1:
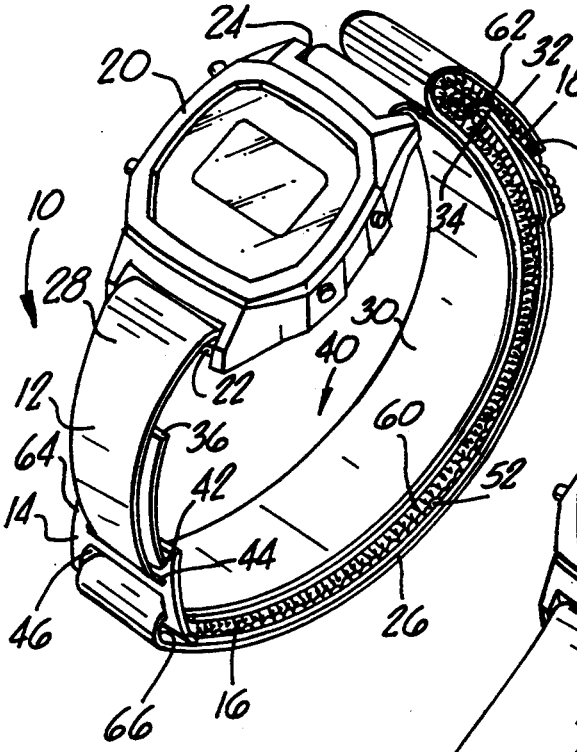
FIG. 1 is a perspective view of a securing band mechanism having features of the present invention and a watch, wherein first and second attaching mechanisms are engaged for securing the mechanism to an object and the mechanism forms a closed loop.
Figure 2:
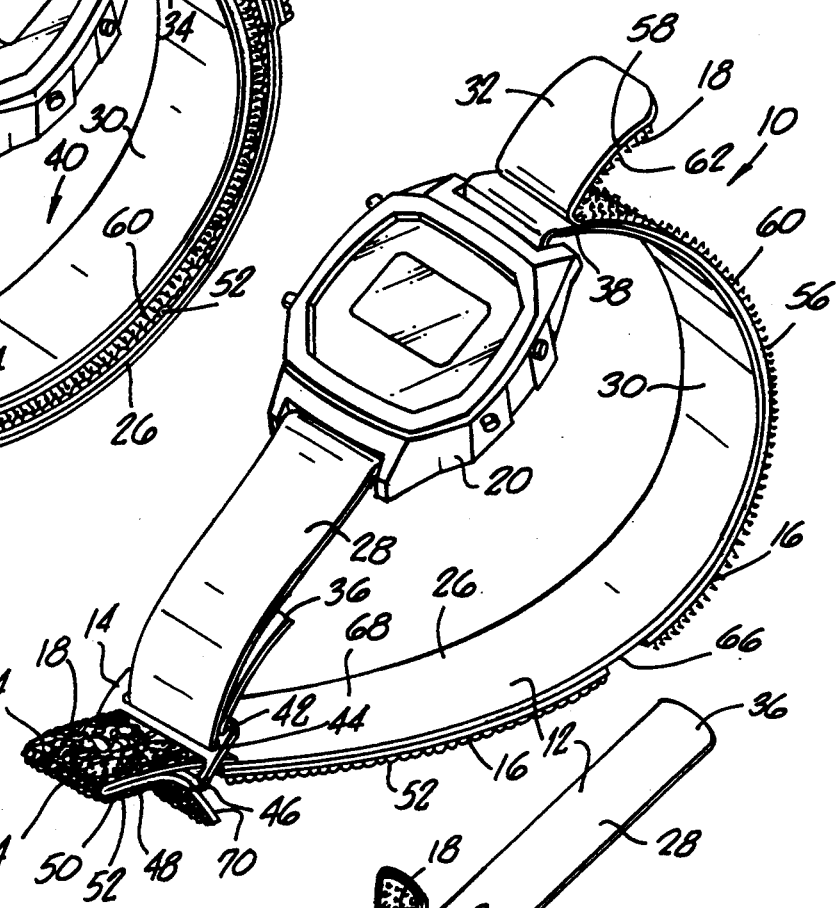
FIG. 2 is a perspective view of the securing band mechanism and watch of FIG. 1 wherein the first and second attaching mechanisms are disengaged.

The first and second attaching mechanisms 16 and 18 are shown in their engaged positions in FIGS. 1 and 2. When the first attaching mechanism is engaged, the first loop material 52 is attached to the first hook material 60 so that the first end section 26 is attached to the first middle section 30. When the second attaching mechanism 18 is engaged, the second loop material 54 is attached to the second hook material 62 so that the first end section 26 is attached to the second middle section 32. The first end section 26 extends through the slotted receiver 14 and is doubled back past the slotted receiver 14 adjacent to and substantially parallel with the first end section 26, before the first and second attaching mechanisms 16 and 18 are engaged.

The securing band mechanism 10 can further have a folding surface 66 in the band 12, as shown in FIGS. 1 through 4. No hook or loop material is attached to the folding surface 66. The band 12 can easily be doubled back past the receiver 14 by placing the receiver 14 near its third slot 46 at the folding surface 66, and folding the band 12 at the folding surface 66. The first end section 26 can then be attached to the first middle section 30.

The securing band mechanism 10 can further comprise an adjustment mechanism 64 for adjustably receiving the second end section 28 so that the closed loop 40 can be size adjusted. In the preferred versions of the invention shown in the drawings, the adjustment mechanism comprises the first and second slots 42 and 44 of the slotted receiver 14. The closed loop 40 can be adjusted in size by sliding the second end section 28 through the first and second slots 42 and 44. The closed loop 40 is made smaller by sliding the second end section 28 so that a greater portion of the second end section 28 extends through the first and second slots 42 and 44. The closed loop 40 is enlarged by sliding the second end section 28 in the opposite direction.

The band 12, as shown in FIGS. 1, 2 and 4 through 7, can be threaded first through the second slot 44 from the convex side and then through the first slot 42. The band 12 can also be threaded through the slotted receiver 14 in another manner. The band 12 can be threaded first through the first slot 42 from the concave side of the slotted receiver 14 and then back through the second slot 44. Either way the closed loop 40 can be size adjusted by sliding the band 12 in the receiver 14 and the securing band mechanism 10 will fit comfortably and snugly on the wrist of a wearer.

The drawings show two different versions of securing band mechanisms having features of the present invention. The first version of the securing band mechanism 10 is shown in FIGS. 1 through 4. In the first version, the second loop material 54 extends less than an entire length of the first end section 26 and the second middle section 32 is thus shorter than in the second version shown in FIGS. 5 through 7. The first version shown in FIGS. 1 through 4 thus provides for free sliding of the first end section 26 in the third slot 46 of the slotted receiver 14 in order to double back the first end section 28 when the first attaching mechanism 16 is activated. Sliding is facilitated by the absence of loop material on a sliding back surface 68 of the first end section 26. When the second loop material 54 extends the entire length of the first end section 26, as shown in the second version of FIGS. 5 through 7, the third slot 46 of the slotted receiver 14 has a tendency to wear the first and second loop material 52 and 54 when the first end section 26 is slid through the third slot 46 to engage or disengage the attaching mechanisms 16 and 18.

Figure 4:
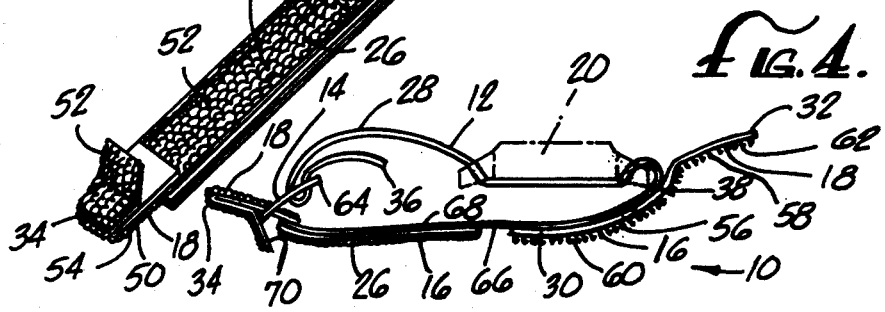
FIG. 4 is a side view of the securing band mechanism of FIGS. 1 and 2 wherein the first and second attaching mechanisms are disengaged and the watch is shown in phantom.

The first version shown in FIGS. 1 through 4 also comprises a catching tab 70 for preventing the first end 34 of the first end section 26 from sliding out of the slotted receiver 14 to open the closed loop 40. The catching tab 70 is part of, and is hingedly attached to, the first end section 26. As shown in FIGS. 2 and 4, when the slotted receiver 14 is slid along the first end section 26 toward the first end 34, the catching tab 70 catches the receiver 14 and prevents the receiver 14 from sliding past the tab 70. When the first attaching mechanism 16 is engaged, the first hook material 60 of the first middle section 30 is attached to the first loop material 52 on the catching tab 70.

Figure 5:
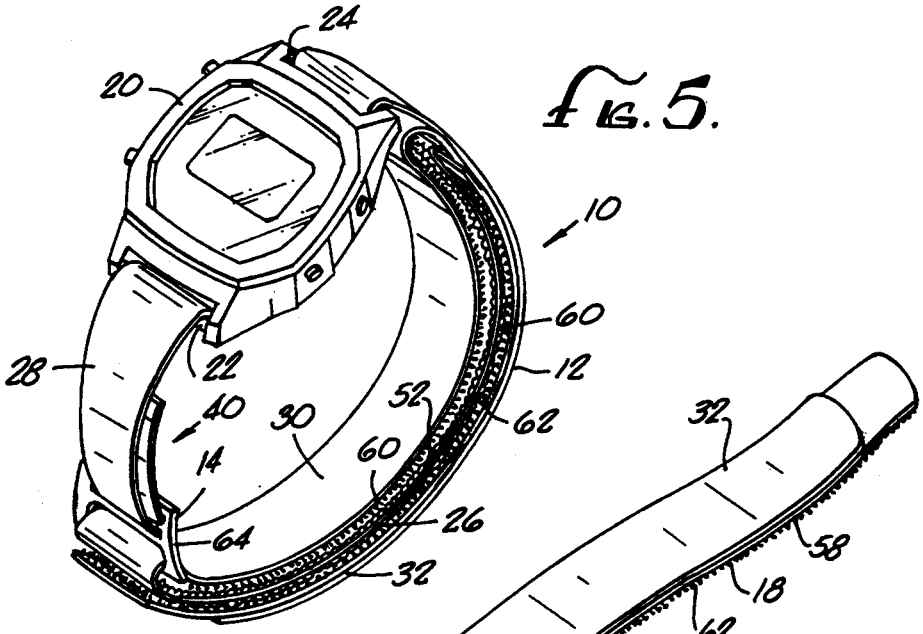
FIG. 5 is a second version of a securing band mechanism having features of the present invention and a watch, wherein first and second attaching mechanisms are engaged and the mechanism forms a closed loop.
Figure 6:
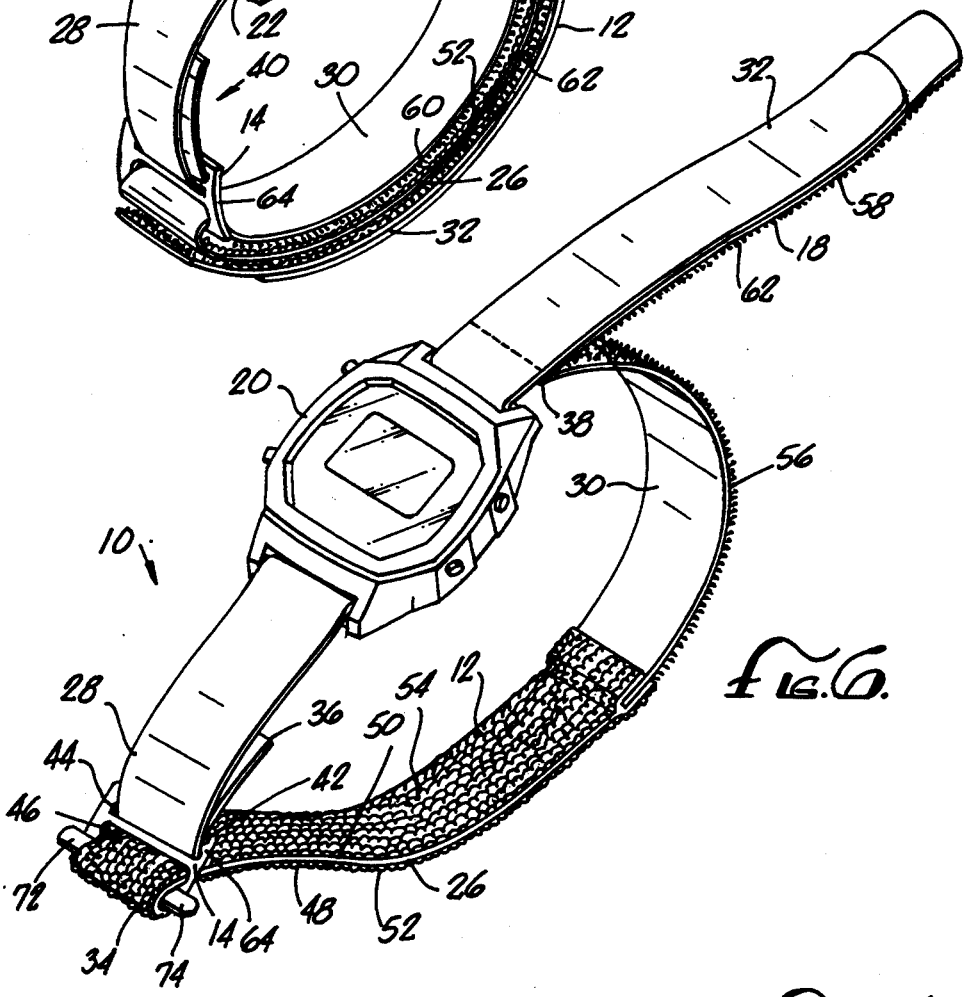
FIG. 6 is a perspective view of the securing band mechanism of FIG. 5 wherein the first and second attaching mechanisms are disengaged.
Figure 7:
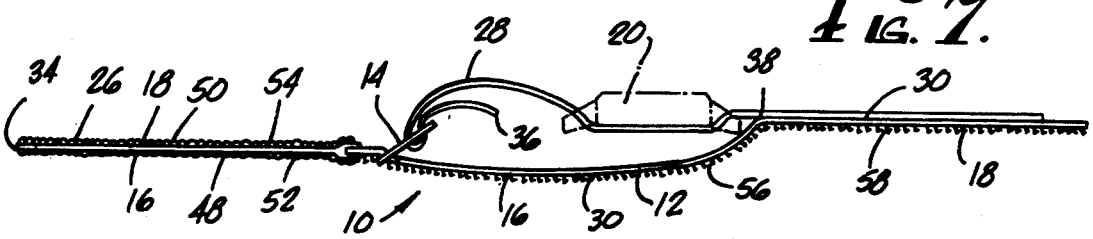
FIG. 7 is a side view of the securing band mechanism of FIGS. 1 and 2 wherein the first and second attaching mechanisms are disengaged and the watch is shown in phantom.

In the second version shown in FIGS. 5 through 7, the second loop material 54 extends substantially an entire length of the first end section 28 along its first end outer surface 50. The second middle section 32 is substantially longer in the second version than in the first version shown in FIGS. 1 through 4, so that the length of the second hook material 62 matches the second hook material 54 on the first end section 26 when the first attaching mechanism 16 is engaged. The second version of the invention thus provides even greater resistance to opening or enlarging the closed loop 40 when the second attaching mechanism 18 is engaged than does the first version shown in FIGS. 1 through 4.

The second version shown in FIGS. 5 through 7 also has a first ear 72 and a second ear 74 which extend laterally substantially perpendicular to the longitudinal axis of the band 12. The first and second ear 72 and 74 prevent the first end 34 of the first end section 26 from sliding out of the slotted receiver 14 to open the closed loop 40. The first and second ears 72 and 74 extend beyond ends of the third slot 46 so the ears 72 and 74 prevent the first end 34 from sliding through the third slot 46.

The band 12 can be made of any flexible material of appropriate strength, durability and comfort (if pertinent) for the use made of the securing band mechanism 10. When used as a watch band, most of the band 12 is preferably made of woven nylon but can also be made of polyester or other suitable material. Woven nylon suitable for the band 12 is available under the designation Nylon Webbing from John Howard Co. at 4510 Schaefer Avenue, Chino, Calif.

The first and second attaching mechanisms 16 and 18 (and portions of the band 12, as described below) can be made of hook and loop material which is sewn or cemented to the band 12, or fused to the band 12 by an ultra-sonic heating process such as that performed by machines available from the Branson Co. at 41 Eagle Road, Danburg, Conn.

The securing band mechanism 10 shown in FIGS. 1 through 4 is simple to make. A strip of woven nylon band of approximately 11.94 to 12.06 inches in length, and approximately 0.75 to 0.83 inch in width, is selected or cut. A first strip of hook material of approximately 3.44 to 3.56 inches in length, and approximately 0.57 to 0.63 inch in width, is heat fused to the woven nylon band starting at about 2.5 inches from one end of the woven nylon band. A first strip of loop material of approximately 2.36 to 2.48 inches in length, and approximately 0.57 to 0.63 inches in width, is heat fused to the woven nylon band between the one end of the woven nylon band and the first strip of hook material, about 0.3 inch from the hook material (in order to form the folding surface 66).

The first strip of hook material and the first strip of loop material are centered laterally on the woven nylon band so that about ⅛ inch of woven nylon material is exposed on each side of the first strip of hook material and the first strip of loop material. This exposed woven nylon band adjacent the first strips of hook and loop material reduces wear of the hook and loop material when the slotted receiver 14 slides along the band 12 and facilitates the sliding. It is preferable to have about a ⅛ inch width of thickness of backing material on each side of the strips of hook and loop material that does not have hook or loop material on the ⅛ inch width. This provides further clearance to avoid wear of the hook and loop material from sliding the receiver 14 and to facilitate the sliding.

To make the second middle section 32 of the version shown in FIGS. 1 through 4, a piece of hook material of about the same width as the woven nylon band is selected, heat welded or fused, and sewn onto the woven nylon band at the end of the strip of hook material away from the strip of loop material.

Next, a section of loop material of about 2.39 to 2.51 inches in length, and about the same width as the strip of loop material, is then folded in half to provide about a 1⅛ inch length of double-sided loop material. The double-sided loop material is then sewn together at about the halfway point of the 1⅛ inch length. One open end of the double-sided loop material is then sewn to the surface of the woven nylon band opposite the strip of hook material at the same end as the strip of loop material. The other loose end of the double-sided loop material then forms the catching tab 70. The slotted receiver 14 is then slid onto the band 12 thereby forming the securing band mechanism 10.

Making the securing band mechanism 10 illustrated in FIGS. 5 through 7 is also simple. A stretch of woven nylon band of approximately the same thickness as the strip of woven nylon band described above, and of approximately 8.69 to 8.81 inches in length, is selected. A second strip of hook material of the same width as the stretch of woven nylon material, and of about 7.94 to 8.06 inches in length, is heat fused onto the woven nylon material so that about ½ inch of the second strip of hook material extends beyond one end of the stretch of woven nylon band. The back side of the second strip of hook material is heat fused along about 3.25 inches of its length to the stretch of woven nylon material. The second strip of hook material is then sewn at the end of the fused woven nylon near the middle of the stretch of woven nylon band. A thin strip of nylon material with a smooth outside surface is then sewn to the back side of the second strip of hook material in the area where the second strip of hook material is not attached to the stretch of woven nylon band.

A length of about 7 inches of loop material is then folded in half thereby creating a 3.5 inch length of double-layered loop material which sandwiches the loose end of the hook material at its open end and is sewn thereon. A piece of rigid plastic or stiff nylon material of about 1¼ inches in length and about 0.25 inch in width is slipped between the loop material just inside the fold of the loop material so that about 3/16 inch of material extends out of each side of the double-layered loop material thereby creating the first and second ears 72 and 74. The matching backings of the double-layered loop material is then heat fused together with the piece of rigid plastic or nylon material inside. The slotted receiver 14 is then slid onto the band 12 to form the securing band mechanism 10.

A securing band mechanism 10 according to the present invention is easy to use. With the slotted receiver 14 in place on the band 12, the closed loop 40 of the securing band mechanism 10 is slipped over the object, such as a person's wrist. The user then pulls the first end 34 of the first end section 26 through the third slot 46 of the slotted receiver 14 until the slotted receiver 14 is adjacent the inside end of the first and second loop material 52 and 54. (In the first version of FIGS. 1 through 4, this is at the folding surface 66.) The closed loop 40 is then checked to see if the band 12 is snug against the object. If not, the adjustment mechanism 64 is appropriately adjusted so the closed loop 40 fits the object and the process is started over. If so, the first end section 26 is folded against the third slot 46 so that it is adjacent to and substantially parallel with the first middle section 30. The first loop material 52 is then pressed against the first hook material 60 thereby engaging the first attaching mechanism 16. The second middle section 32 is next brought up adjacent to and substantially parallel with the first end section 26. The second hook material 62 is then attached to the second loop material 54 thereby activating the second attaching mechanism 18. The securing band mechanism 10 is now in place on the object.

Although the present invention has been described in considerable detail with reference to certain preferred versions thereof, other versions are possible. Therefore, the spirit and scope of the appended claims should not be limited to the description of the preferred versions contained herein.

What is claimed is:

1. A securing band mechanism for snugly and securely wrapping around an object, the securing band mechanism comprising:

(a) a band having:

(i) a first end section having a first end;

(ii) a second end section having a second end;

(iii) a first middle section between and attached to the first end section and the second end section; and (iv) a second middle section having an attaching end hingedly attached to the first middle section;

(b) a slotted receiver connected to the second end section for receiving the first end of the band so that the band can form a closed loop;

(c) a first attaching mechanism connected to the band for selectively attaching the first end section to the first middle section; and (d) a second attaching mechanism connected to the band for selectively attaching the first end section to the second middle section, so that when (i) the first end section extends through the receiver and is doubled back adjacent to and substantially parallel with the first middle section; and (ii) the first and second attaching mechanisms are engaged, the first end section is attached to the first middle section and to the second middle section.

2. The securing band mechanism of claim 1 further comprising an adjustment mechanism for adjustably receiving the second end section so that the closed loop can be size adjusted by sliding the second end section through the adjustment mechanism.

3. The securing band mechanism of claim 1 wherein the slotted receiver comprises first and second slots connected to the second end section.

4. The securing band mechanism of claim 1 wherein:

(i) the first end section has a first end inner surface and a first end outer surface;

(ii) the first middle section has a first attaching surface; and (iii) the second middle section has a second attaching surface, the first attaching mechanism comprising first loop material attached to the first end inner surface and first hook material attached to the first attaching surface, the second attaching mechanism comprising second loop material attached to the first end outer surface and second hook material attached to the second attaching surface, the first end section being attached to and between the first middle section and the second middle section when the first and second attaching mechanisms are activated.

5. The securing band mechanism of claim 4 further comprising a folding surface in the band between the first loop material and the first hook material, the folding surface facilitating folding of the band at the folding surface when the receiver is placed at the folding surface so that the first end section can easily be doubled back past the receiver and attached to the first middle section.

6. The securing band mechanism of claim 4 wherein the second loop material extends substantially an entire length of the first end section.

7. The securing band mechanism of claim 4 wherein the second loop material extends less than an entire length of the first end section, thereby allowing the slotted receiver to freely slide along the first end section to enlarge or make smaller the closed loop.

8. The securing band mechanism of claim 1 wherein the slotted receiver comprises first, second and third slots, the first and second slots being dimensioned and configured for receiving the second end so that the closed loop can be size adjusted by sliding the second end section through the second and third slots, the third slot for receiving the first end so that the first end section can extend through the slotted receiver and be doubled back past the receiver.

9. The securing band mechanism of claim 1 further comprising first and second ears attached adjacent the first end for preventing the first end from sliding out of the slotted receiver to open the closed loop, the first and second ears extending laterally from the band.

10. The securing band mechanism of claim 7 further comprising a catching tab hingedly attached to the first end section for preventing the first end from sliding out of the slotted receiver to open the closed loop.

11. A securing watch band mechanism for holding a watch and for snugly and securely wrapping around a person's wrist, the securing watch band mechanism comprising:

(a) a band connected to the watch, the band having:

(i) a first end section having a first end;

(ii) a second end section having a second end;

(iii) a first middle section between and attached to the first end section and the second end section; and (iv) a second middle section having an attaching end hingedly attached to the first middle section;

(b) an adjustment mechanism for adjustably receiving the second end section so that the closed loop can be size adjusted by sliding the second end section through the adjustment mechanism;

(c) a slotted receiver connected to the second end section for receiving the first end of the band so that the band can form a closed loop;

(d) a first attaching mechanism connected to the band for selectively attaching the first end section to the first middle section; and (e) a second attaching mechanism connected to the band for selectively attaching the first end section to the second middle section, so that when (i) the first end section extends through the receiver and is doubled back adjacent to and substantially parallel with the first middle section; and (ii) the first and second attaching mechanisms are engaged, the first end section is attached to and between the first middle section and the second middle section.

12. The securing band mechanism of claim 11 wherein the slotted receiver is integral with the adjustment mechanism.

13. The securing band mechanism of claim 11 wherein the adjustment mechanism comprises first and second slots in the slotted receiver.

14. The securing band mechanism of claim 11 wherein:

(i) the first end section has a first end inner surface and a first end outer surface;

(ii) the first middle section has a first attaching surface; and (iii) the second and middle section has a second attaching surface, the first attaching mechanism comprising first loop material attached to the first end inner surface and first hook material attached to the first attaching surface, the second attaching mechanism comprising second look material attached to the first end outer surface and second hook material attached to the second attaching surface.

15. The securing band mechanism of claim 14 wherein the second loop material extends substantially an entire length of the first end section.

16. The securing band mechanism of claim 14 wherein the second loop material extends less than an entire length of the first end section, thereby allowing the slotted receiver to freely slide along the first end section to enlarge or make smaller the closed loop.

17. The securing band mechanism of claim 11 further comprising a catching tab hingedly attached to the first end section for preventing the first end from sliding out of the slotted receiver to open the closed loop.

18. A watch apparatus for attachment to a person's wrist, the watch apparatus comprising:

(a) a watch;

(b) a band attached to the watch for snugly and securely securing the watch to the person's wrist, the band having:

(i) a first end section having a first end;

(ii) a second end section having a second end;

(iii) a first middle section between and attached to the first end section and the second end section; and (iv) a second middle section having an attaching end hingedly attached to the first middle section;

(c) a slotted receiver connected to the second end section for receiving the first end of the band so that the band can form a closed loop;

(d) a first attaching mechanism connected to the band for selectively attaching the first end section to the first middle section; and (e) a second attaching mechanism connected to the band for selectively attaching the first end section to the second middle section, so that when (i) the first end section extends through the receiver and is doubled back adjacent to and parallel with the first middle section; and (ii) the first and second attaching mechanisms are engaged, the first end section is attached to the first middle section and to the second middle section.

19. The securing band mechanism of claim 18 further comprising an adjustment mechanism for adjustably receiving the second end section so that the closed loop can be size adjusted by sliding the second end section through the adjustment mechanism.

20. A securing band mechanism for snugly and securely wrapping around an object, the securing band mechanism comprising:

(a) a band having:

(i) a first end section having a first end, the first end section having a first end inner surface and a first end outer surface;

(ii) a second end section having a second end;

(iii) a first middle section between and attached to the first end section and the second end section, the first middle section having a first attaching surface; and (iv) a second middle section having an attaching end hingedly attached to the first middle section of the band, the second middle section having a second attaching surface;

(b) a slotted receiver connected to the band for slidably receiving both the first and second ends of the band so that the band can form a closed loop around the object;

(c) a first attaching mechanism connected to the band for selectively attaching the first end section to the first middle section, the first attaching mechanism comprising first loop material attached to the first end inner surface and first hook material attached to the first attaching surface; and (d) a second attaching mechanism connected to the band and the second middle section for selectively attaching the first end section to the second middle section, the second attaching mechanism comprising second loop material attached to the first end outer surface and second hook material attached to the second attaching surface, so that when (i) the first end section extends through the receiver and is doubled back adjacent to and substantially parallel to the first middle section; and (ii) the first and second attaching mechanisms are engaged, the first end section is attached to and between the first middle section and the second middle section.

21. The securing band mechanism of claim 20 further comprising an adjustment mechanism for adjustably receiving the second end section so that the closed loop can be size adjusted by sliding the second end section through the adjustment mechanism.

22. The securing band mechanism of claim 20 wherein the second loop material extends less than an entire length of the first end outer surface thereby allowing the slotted receiver to freely slide along the first end section to enlarge or make smaller the closed loop.

* * * * *